United States Patent [19]

Roczyn

[11] Patent Number: 4,631,236

[45] Date of Patent: Dec. 23, 1986

[54] PROCESS FOR MANUFACTURING A DEVICE AND EXTRUSION BILLET FOR THIS

[75] Inventor: Hans-Gerd Roczyn, Hilzingen, Fed. Rep. of Germany

[73] Assignee: Swiss Aluminium Ltd., Chippis, Switzerland

[21] Appl. No.: 702,001

[22] Filed: Feb. 14, 1985

[30] Foreign Application Priority Data

Feb. 23, 1984 [DE] Fed. Rep. of Germany ..... 3406560

[51] Int. Cl.[4] ..... B22F 3/02; B21C 23/22; C22C 21/00; C22C 21/10

[52] U.S. Cl. ..... 428/558; 420/528; 420/532; 420/533; 420/537; 420/541; 420/542; 420/548; 420/550; 427/423; 427/427; 428/548; 428/550; 419/67; 72/258

[58] Field of Search ..... 428/558, 559, 654; 419/8, 9, 12, 41, 67; 72/258, 259; 427/423, 427; 420/528, 533, 534, 541, 542, 546, 550; 75/244, 254

[56] References Cited

U.S. PATENT DOCUMENTS

| | | | |
|---|---|---|---|
| 1,916,087 | 6/1933 | Titus | 420/546 |
| 3,139,983 | 7/1964 | Erbsloh et al. | 207/4 |
| 3,235,961 | 2/1966 | Champion et al. | 29/527 |
| 3,305,384 | 2/1967 | Kenderi | 117/71 |
| 3,676,113 | 7/1972 | Pryor et al. | 420/541 |
| 3,788,820 | 1/1974 | Hunt | 29/187 |
| 3,881,879 | 5/1975 | Singleton, Jr. et al. | 420/546 |
| 4,208,898 | 6/1980 | Ames et al. | 72/258 |
| 4,224,267 | 9/1980 | Lugosi et al. | 264/111 |

*Primary Examiner*—John F. Terapane
*Assistant Examiner*—Eric Jorgensen
*Attorney, Agent, or Firm*—Bachman & LaPointe

[57] ABSTRACT

A process and a device for manufacturing an extruded section of an aluminum alloy containing additions of boron or compounds thereof are intended to simplify the manufacture of aluminum alloy sections for use in nuclear science and technology. Using a boron-containing aluminum-based raw material a section is to be formed such that its design ensures adequate stability and at the same time the necessary screening properties. To this end a billet having a core of aluminum alloy with additions of boron or the like and a mantel surrounding the same is manufactured and hot formed by extrusion, such that, using the molten metal route or powder metallurgy, a blank of aluminum alloy of particular alloy groups with additions of boron or its compounds at a concentration of 0.05 to 50 wt % is taken as the starting basis. Further, starting from these alloy groups, an extrusion of at least two strips delimiting a hollow space can be made from a boron-free aluminum alloy and the space filled with feed material in the form of wire or powder. A device for this is such that a billet comprises a core of aluminum alloy with additions of boron or the like and, surrounding this, a mantel of essentially boron-free aluminum alloy.

2 Claims, 2 Drawing Figures

PROCESS FOR MANUFACTURING A DEVICE AND EXTRUSION BILLET FOR THIS

BACKGROUND OF THE INVENTION

The present invention relates to a process for manufacturing a device which is made from an aluminum alloy containing additions of boron or compounds thereof and is provided with an outer surface of aluminum, and relates too to an extrusion billet for carrying out the process.

It is known practice to manufacture rolled aluminum-boron composite panels which are assembled to provide housings to enclose and screen off neutron-emitting materials. The fraction of boron or its compounds in the aluminum alloy enables the thermal neutrons to be absorbed.

A disadvantage of rolling such composite panels is that the resultant product is of constant thickness. Regions of the housing subject to high local static loading must therefore be reinforced by additional structural parts.

In view of these facts the object of the present invention is to achieve simpler manufacture of sections of aluminum alloys for use in nuclear science and technology. Using a boron-containing aluminum-based raw material it should be possible to make a section which is such that it simultaneously ensures adequate stability and screening.

SUMMARY OF THE INVENTION

The foregoing object is achieved by way of a process wherein a billet having a core of aluminum alloy containing additions of boron or compounds thereof and a mantel enclosing the same are manufactured and shaped by extrusion, preferably employing as basis blanks which are made via the molten metal route or powder metallurgy and viz., from an aluminum-based material of the alloy group/groups: high purity aluminum, AlFe, AlFeSi, AlMn, AlMg, AlMgMn, AlMgSi, AlZnMg, AlZnMgCu, AlCuMg, AlCuSiMn with additions of boron or its compounds (preferably $B_4C$) at a concentration of 0.05 and 50 wt %. According to the invention this billet can be extruded directly or indirectly to sections, rods or pipes; as such a lower hot forming temperature limit of 250° C. and the solidus temperature of the alloy in question as the upper limit have proved favorable in this connection. In the case of billets made via powder metallurgy the hot forming temperature and the specific extrusion force are chosen such that hot welding occurs between the individual aluminum particles, thus making it possible to produce a compact extrusion.

The billet according to the present invention for manufacturing sections, rods or pipes from the above mentioned alloys containing boron, comprises a core of boron-containing aluminum alloy which is surrounded by a mantel of boron-free aluminum alloy. As a result of this cladding the extrusion die and container of the extrusion press are protected from abrasive wear by the boron and its compounds, and, at the same time, the corrosion resistance of the composite is increased.

According to further features of the present invention the mantel of the billet is deposited by thermal spraying either in one piece or in the form of a plurality of parts which are joined together. In the case of the latter a cylinder shaped part surrounds the circumference of the billet while a front disc and back end plate cover the ends of the billet.

Usefully, the above mentioned ingot parts are produced by deep drawing or extrusion or from shaped sheet material and these introduced into the container either loose and sequentially or first welded together before insertion into the bore of the container.

It has to be found favorable to complete the ingot mantel, made of individually manufactured parts, with pre-shaped casting, pre-pressed powder blank, or by filling with a powder of the boron containing alloy.

Also within the scope of the invention is to make a kind of receptacle or canister for the core from the cylindrical part and end disc or plate, which is then closed off by the end disc or plate ater filling with powder. If such a canister is employed, the cold prepressing of a powder blank from the boron containing alloy can be omitted.

After heating in the extrusion press container at the hot forming temperature, the described canister is hot sealed. The lid of the canister must, according to the invention, feature an opening to permit air to be expelled.

According to another feature of the invention, when employing billets made via powder metallurgy, with or without mantel, the hot sealing of the powder blank is performed either by pressing against a die with a die opening which provides an extrusion ratio of $>5:1$, or else by previously pressing against a dummy plate at the exit end of the container.

In order to achieve more efficient use of the boron-containing material and to make the separation of waste easier, the back end plate of the billet mantel is thicker than the residual ingot butt produced during extrusion; this enables the core to be extruded completely.

The invention also embraces a composite section without mantel and the production of such a section via the Conform process or via an extrusion device such as can be understood from the German patent publication DE-OS No. 27 08 458 where at least one friction or shaping wheel situated ahead of a die feeds a metal strip to the die for the purpose of producing a composite section. Thus, according to the invention, an extruded section is manufactured out of at least two strips which are made of a boron-free aluminum alloy and delimit a space which is filled with feedstock in the form of wire or powder likewise of an aluminum based alloy material selected from the group consisting of aluminum, AlFe, AlFeSi, AlMn, AlMg, AlMgMn, AlMgSi, AlZnMg, AlZnMgCu, AlCuMg, AlCuSiMn with additions of boron or its compounds (preferably $B_4C$) at a concentration of 0.05–50 wt %. To this end such a cast and rolled wire or powder of the above mentiond boron-containing aluminum alloys is introduced between the friction wheel and die. In addition two strips of a boron-free aluminum alloy participate in the process, one of the strips being U-shaped and running in a ring-shaped groove in the fraction wheel, the other strip sliding along the die.

The two strips together form a trough-shaped space to accommodate the feedstock which is in the form of wire or powder. By welding both of the strips to the core material a fully clad extruded product is produced.

In another process according to the invention composite sections or rods or aluminum alloys with a boron-containing core of the above mentioned kind are extruded such that the core material, in rod, wire or powder form, is introduced through a hollow mandrel to a point immediately upstream of the die, or if using powder also immediately behind i.e. downstream of the die. On pressing out the described composite billet of core and mantel the core is, according to the invention, carried along by frictional forces or the powder is sucked in by negative pressure and completely encased in the mantel material.

When operating the process just described, the feeding of the core material can advantageously be performed from the side using a special die such as is known for lateral feeding of a section component.

The resultant sections, rods and pipes with boron-containing component and produced according to the invention by means of extrusion are employed particularly to advantage in nuclear science and technology applications to provide protection from thermal neutrons.

BRIEF DESCRIPTION OF THE DRAWINGS

Further advantages, features and details of the invention are revealed in the following description of preferred exemplified embodiments and with the aid of the drawings viz., FIG. 1 A longitudinal section through an extrusion billet.

DETAILED DESCRIPTION

Figure 1:
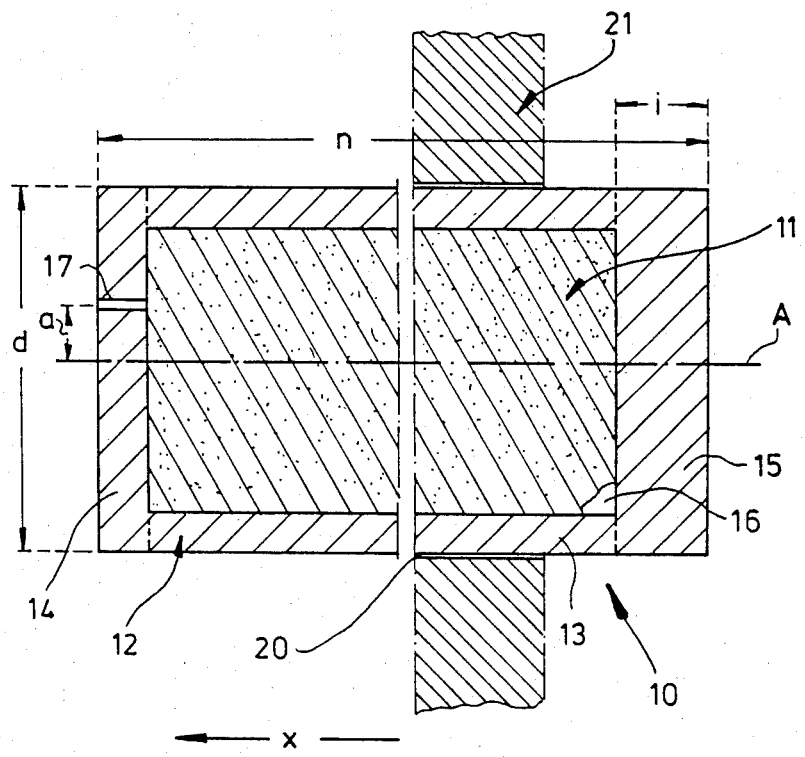
Figure 2:
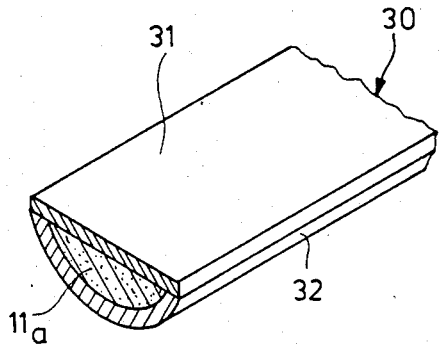
FIG. 2 A perspective view of an extruded section.

FIG. 1 shows a billet 10 of diameter d and length n for production of sections by extrusion where the core 11 of the said billet 10 is an aluminum-boron alloy inside a mantel 12 comprising a cylindrical part 13, a front end disc 14 (with respect to the direction of extrusion x) and a back end plate 15.

The mantel 12 is of a boron-free aluminum alloy which is thermally sprayed onto the core 11. As such, the thickness i of the back end plate 15 is chosen such that it is greater than the thickness of the ingot butt remaining after extrusion, which permits complete extrusion of the core 11.

In another version of the billet 10 the mantel 12 is made up of the parts 13, 14, 15 which in turn are made by deep drawing, extrusion or shaping of sheet material. The parts 13, 14, 15 are either introduced loose into the bore 20 of a container 21 and assembled there into the form of a mantel 12, or welded together in front of the container. The core 11 is formed by introducing a preshaped casting, or a previously pressed powder compact, into the interior 16 of the mantel 12, subsequently fitting on the back end plate 15, or by pouring in loose powder.

If, by joining the cylindrical part 13 to the front end disc 14 or back end plate 15, a canister with base is prefabricated, then the prior cold pressing of the powder into a charge can be eliminated. The canister 13, 14 or 13, 15 is filled with powder and closed off with a lid 15 or 14. After heating, this canister is hot compacted at the extrusion temperature in the container 21 of the extrusion press. The canister lid, for example end disc 14, must the feature an opening 17, situated either at the central axis A or at a distance a from it, in order to allow air to be expelled from the canister.

If the core 11 of the billet 10, with or without mantel 12, is made via powder metallurgy, the hot compaction of the blank is performed by pressing against a die, for simplicity omitted from the drawing, which permits an extrusion ratio of $>5:1$, or by prior pressing against a blank disc that closes off the front end of the container, again for simplicity omitted here.

Clad sections made by the so-called Conform process or by double friction wheel extrusion are such that a mantel 30 is formed around a core 11*a* by two strips 31, 32. Double friction wheel extrusion is described in greater detail in the German patent publication DE-OS No. 27 08 458; the two strips 31, 32 are introduced into a gap between two wheels which turn towards a shaping tool into which they feed the said strips 31, 32. In the process according the invention strip 32 is approximately U-shaped and runs in a ring-shaped groove of the wheel, while the second strip 31 slides along the shaping tool. Together the strips 31, 32 form a trough-shaped space which is filled with material in the form of wire or powder to give the core 11*a*. By welding both strips 31, 32 to the core 11*a* a fully clad extrusion product is created.

Not shown in the drawings is the manufacture of composite sections or rods of aluminum alloys with a boron-containing core material by introducing the last mentioned in rod, wire or powder form through a hollow mandrel until just in front of a die, or feeding powder immediately after a die. On extruding a tubular type billet the core material is carried along by friction forces, or the powder is sucked in due to negative pressure, and then by means of extrusion completely encased in a mantel of boron-free aluminum alloy.

What is claimed is:

1. An extrusion billet having a blank core and a mantel surrounding said core wherein said core is formed from a material comprising an aluminum alloy selected from the group consisting of high purity aluminum, AlFe, AlFeSi, AlMn, AlMg, AlMgMn, AlZnMg, AlZnMgCu, AlCuMg and AlCuSiMn with additions of boron in a concentration of between 0.05 to 50 wt. % and said mantel is formed from a boron free aluminum alloy.

2. An extrusion billet according to claim 1 including providing a hole penetrating the mantel.

* * * * *